United States Patent [19]

Szabo

[11] 4,292,699

[45] Oct. 6, 1981

[54] GRINDING MACHINE FOR DELIMITED GROOVE MACHINING ON CUTTING TOOLS

[76] Inventor: Tibor Szabo, 2506 West Ave., 130th, San Leandro, Calif. 94577

[21] Appl. No.: 104,262

[22] Filed: Dec. 17, 1979

[51] Int. Cl.[3] ..... B24B 3/34

[52] U.S. Cl. ..... 51/94 R; 51/124 R; 51/231; 51/240 R

[58] Field of Search ..... 51/92 R, 93, 94 R, 98 R, 51/98.5, 122, 124 R, 125, 125.5, 218 R, 218 A, 230, 231, 240 R, 240 A; 269/71, 73; 409/81

[56] References Cited

U.S. PATENT DOCUMENTS

| | | | |
|---|---|---|---|
| 1,006,258 | 10/1911 | Mohr | 51/92 R |
| 1,294,779 | 2/1919 | Demers et al. | 51/92 R |
| 1,431,024 | 10/1922 | Munthe | 51/218 A |
| 1,619,021 | 3/1927 | Gouldbourn | 51/92 R |
| 1,915,247 | 6/1933 | Holloway et al. | 51/92 R |
| 2,118,912 | 5/1938 | Armitage | 51/125 X |
| 2,454,472 | 11/1948 | Monkley | 51/124 R X |
| 2,958,988 | 11/1960 | Crosby | 51/122 |
| 3,020,681 | 2/1962 | Hite | 51/124 X |
| 3,084,486 | 4/1963 | Orciani | 51/125 |

*Primary Examiner*—Gary L. Smith
*Assistant Examiner*—Robert P. Olszewski
*Attorney, Agent, or Firm*—Bielen and Peterson

[57] ABSTRACT

A grinding machine, particularly designed for machining a chipbreaker groove into the cutting edge of a cutting tool, the grinding machine has a support base and an abrasion wheel mounted to the support base, a workpiece table with anchoring fasteners for securing a workpiece to the table; a pedestal fixed to the support base with a pivot block connected to the pedestal by a vertical adjustment mechanism, the pivot block having a cooperating slide and pivot mechanism connecting the pivot block to the work-piece table for pivoting the table about a horizontal axis and sliding the table along the same horizontal axis; stop devices for delimiting the degree of pivot and length of slide of the work-piece table; and, guage indicators for defining the degree of pivot height and slide length of the work table.

13 Claims, 9 Drawing Figures

FIG-3
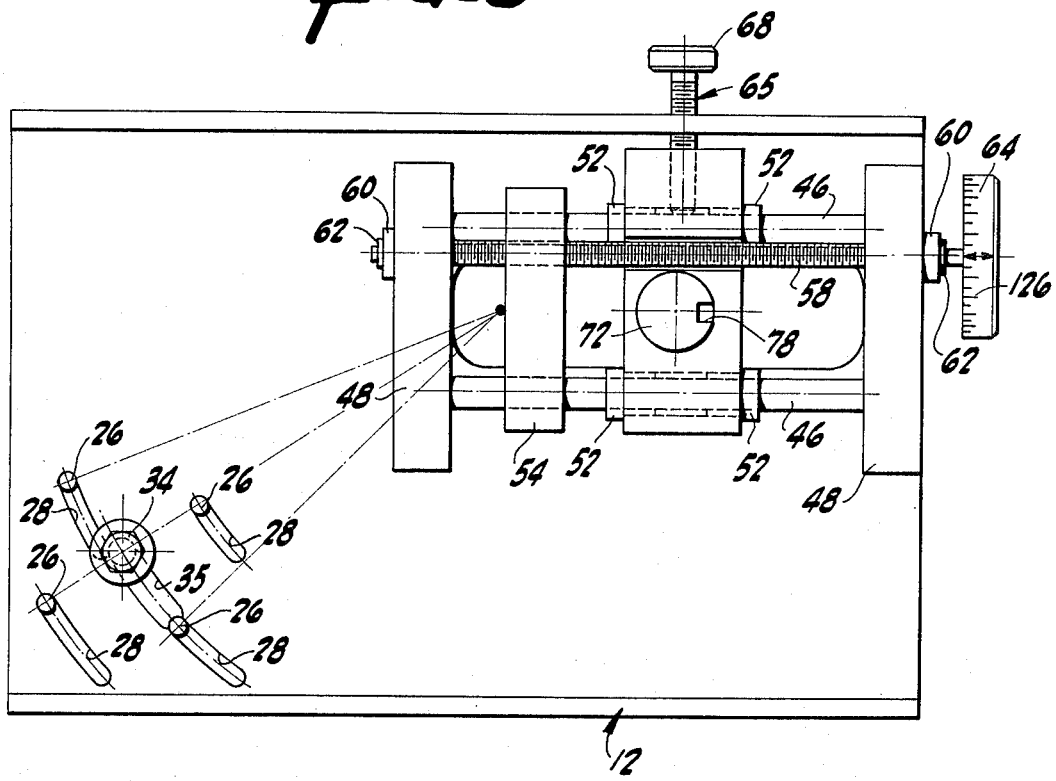
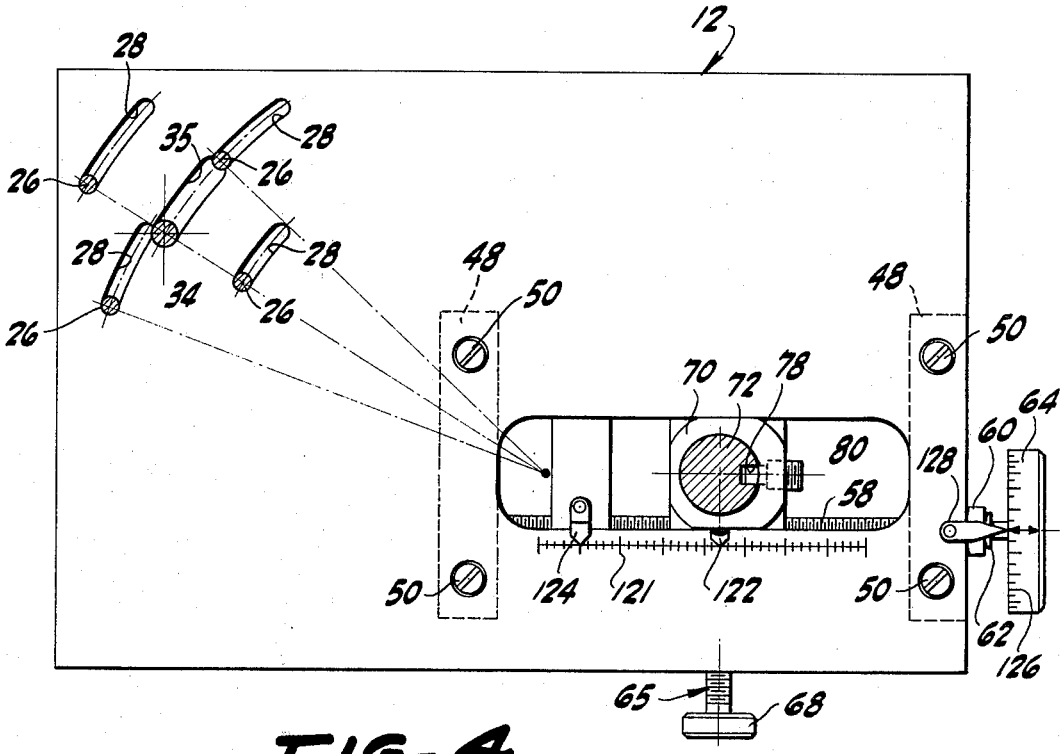
FIG-4

37
148
18
16
84
90
106
86
104
94
98
92
82
96
74
76
128
30
70
44
71
46
64
48
54
72
58
48
12

-7-
16
88a
88b
138
140
114
90
84
110
112
106
108
130
86
104
132
98
103
100
94
82
102
92
136
134
72
96
74
315
0
45
76
12
80
44
71
50
46
52
54
78
48
-7-

GRINDING MACHINE FOR DELIMITED GROOVE MACHINING ON CUTTING TOOLS

BACKGROUND OF THE INVENTION

This invention relates to a grindingg device for preparing the edge of a cutting tool used in machining operations.

More specifically, this grinding device is particularly suitable for providing a semicircular, longitudinal groove on the cutting face of a cutting tool which groove comprises a chipbreaker.

It has been discovered that the placement of a semicircular or eliptical groove on the cutting face of a cutting tool displaced a short distance from the cutting edge will cause the ribbon-like continuous chip to break into short chip particles. This is desirable not only for convenience in handling cleanup and disposal of waste metal in chip form, but to prevent the chip in ribbon form from fouling the cutting operation, or particular concern in automatic or semiautomatic cutting operations.

However, the precision with which the chipbreaker groove must be dimensioned and located on the cutting face of the cutting tool enables only the most highly skilled of the machinists to properly prepare a cutting edge. Because each material being machined may require a somewhat different optimum cutting edge configuration, which may further vary due to cutting speed, depth of cut, radius of piece, etc., the edge preparation becomes an art based on a machinist's ability and experience. Because these cutting edges are hand ground (except where factory prepared), it is virtually impossible to convey information about cutting edge specifications except through demonstration and visual inspection.

While proper preparation of a cutting tool edge having a chipbreaker is a primary use of the invented machining device because of the extreme difficulty of this operation, the machining device can be used for preparation of other complex edge configurations. For example, certain cutting operations can best be performed with a cutting tool having a "K" land at the cutting edge which is a chamfer or bevel also known as a land angle incorporated into the tool edge.

Because of the complexity of these exotic edges, cutting tools are often provided with factory prepared inserts which are discardable after the life of the factory prepared edge. The inserts are generally not repairable by grinding to rehabilitate a worn or chipped edge. The use of inserts, however, restricts the user to certain fixed edge configurations and is often an added expense only because of the inability to properly prepare the cutting edge of a conventional carbide or tungsten tool. The precision of this grinding machine permits factory prepared inset to be repaired or altered for optimum cutting.

SUMMARY OF THE INVENTION

The grinding device of this invention comprises a precision abrasion machining device for accurately preparing the lead surfaces of a cutting tool.

In recognition of the variety of complex configurations of the cutting surfaces of cutting tools and the extreme difficulty of duplicating a cutting edge or point found by experience or experiment to be optimum, Applicant has devised a machining device that will not only permit accurate formation of the edge desired, but allow for subsequent duplication of this edge by use of recorded specifications.

In this specification, the term "lead surfaces" will mean generally those surfaces at the end of a cutting tool which converge to form a cutting edge or cutting point. Such lead surfaces are prepared in a preliminary fashion by conventional grinding machines and methods, whereby the cutting tool is fashioned with the appropriate rake angle, clearance angle and general configuration necessary for the particular machining operation to be performed. The term "cutting edge" is used herein to include the edge or edges and a portion of the lead surfaces adjacent the actual edge, edges or point that performs the removal of material from the work-piece and which generally requires special machining. The critical finish preparation requires close control which, heretofore, has only been possible by the manual fashioning of the most skilled and experienced machinist. One of the most difficult of cutting edge configurations to fashion is one including a chipbreaker, which is a groove of a semicircular or arcuate configuration displaced from the actual edge but which forms an overall cutting edge that breaks the sheared material into short segments or chips. The precision abrasion machining device of this invention is designed to fashion a cutting edge with a chip-breaker with ease. The grinding wheel for tool grinding is preferably a diamond grit wheel. This wheel may be replaced by other grinding wheels fabricated of other mterials for a variety of general grinding operations on workpieces of different materials. These and other features of the invention will become apparent on a consideration of the Detailed Description of the Preferred Embodiment.

BRIEF DESCRIPTION OF THE DRAWINGS

FIG. 3 is a bottom view taken on the lines 3—3 in FIG. 2.

FIG. 4 is a cross-sectional view taken on the lines 4—4 in FIG. 2.

DETAILED DESCRIPTION OF THE PREFERRED EMBODIMENT

Figure 1:
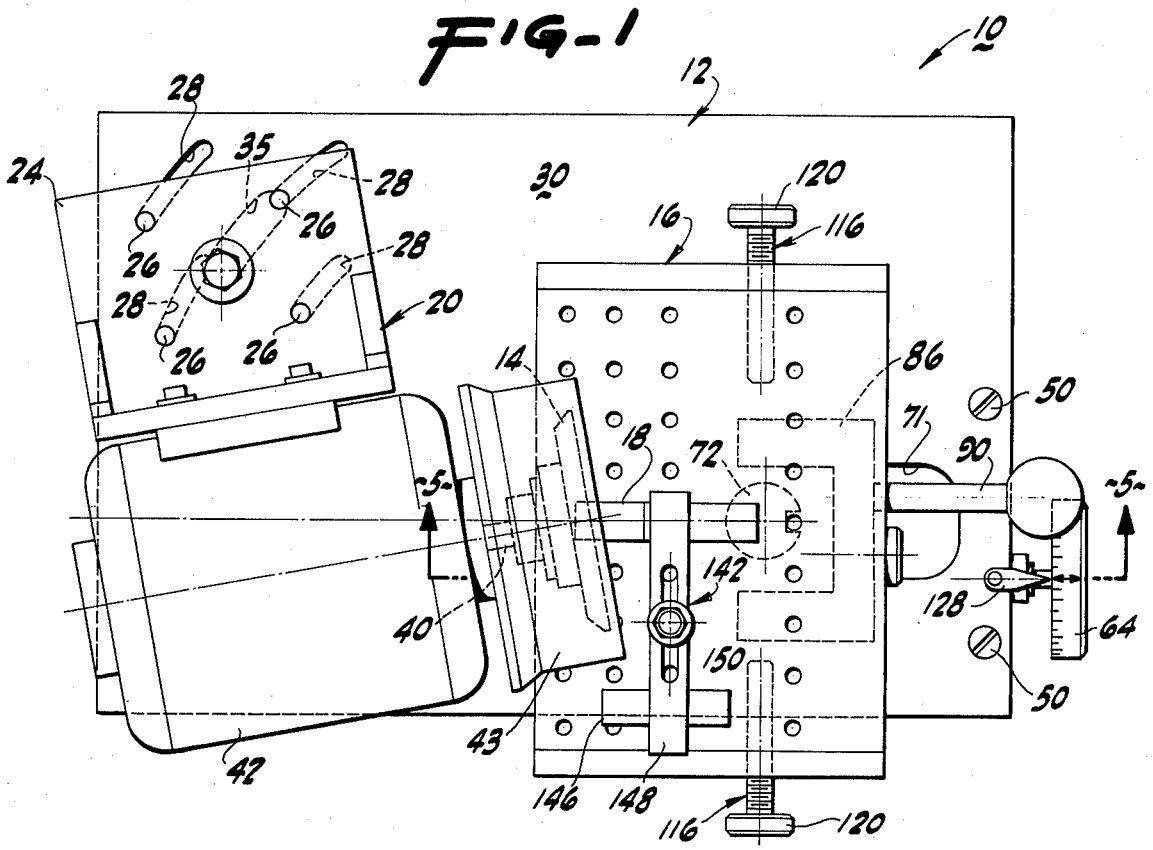
FIG. 1 is a top plan view of the grinding device.

The grinding device of this invention designated generally by the reference numeral 10 in FIG. 1, comprises a precision machine for controlled grinding or abrasive machining and is particularly adapted for the preparation of the cutting edges of cutting tools or cutting tool inserts. The grinding device 10 is constructed with a base platform 12 which provides the support for grinding wheel 14 and a movable working table 16 on which a work piece 18 is mounted.

Figure 2:
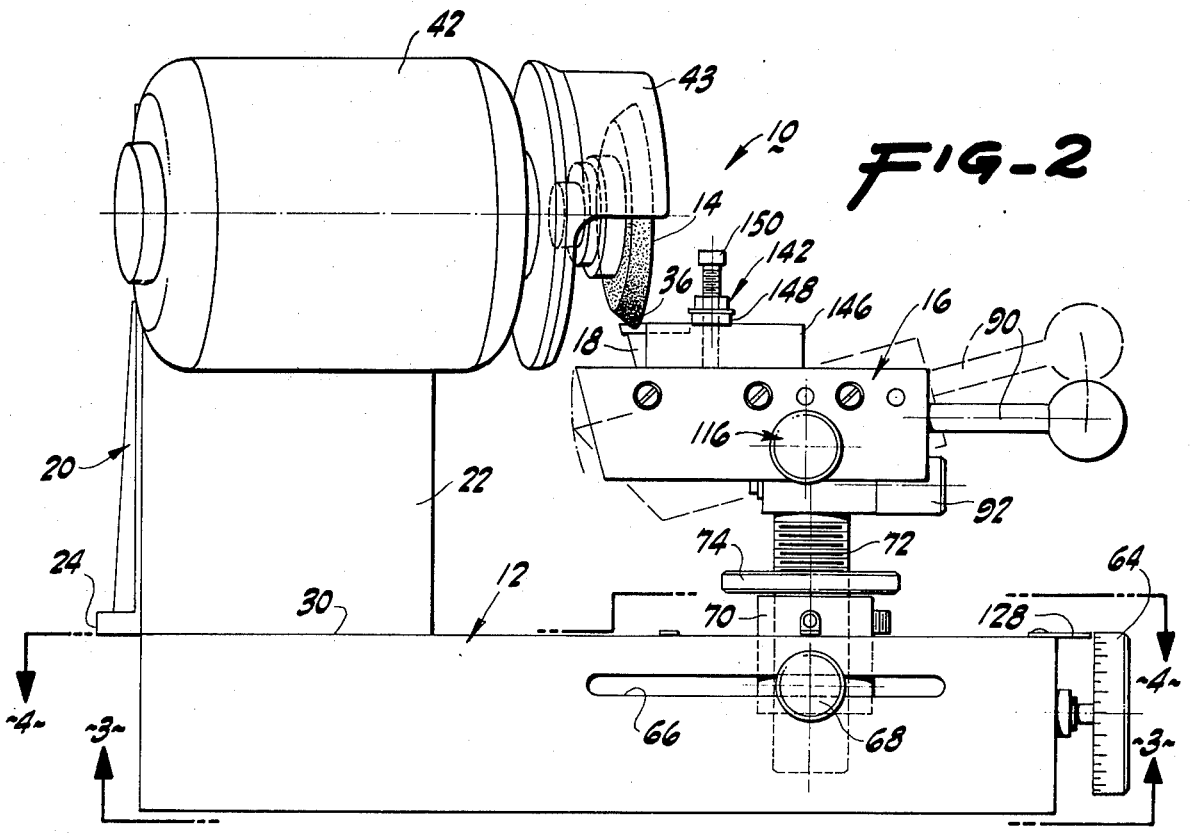
FIG. 2 is a side elevational view of the grinding device.
Figure 8:
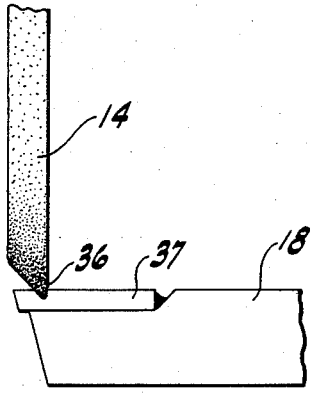
FIG. 8 is a schematic view of the grinding wheel of the grinding device and a cutting tool.
Figure 9:
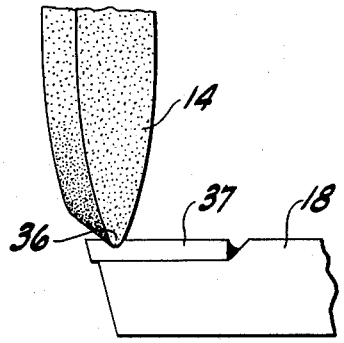
FIG. 9 is a schematic view of the grinding wheel of FIG. 8 in an alternate orientation and a cutting tool.

The base platform 12 provides a solid support for a motor mount 20 which comprises a support member 22 having a base plate 24 with four depending location pins 26 that engage arcuate locating slots 28 in a corner of the top plate 30 of the base plateform 12 as further shown in FIG. 2. The base plate 24 is secured to the top plate 30 of the base platform 12 by a nut and bolt fastener 34 located through an arcuate slot 35 in the top plate 30. The arcuate configuration of the slots is designed on a radius to the vertical centerline edge of the grinding wheel such that the grinding wheel can be skewed up to 10° as shown to change the effective grinding curvature of the beveled and rounded edge 36 of the diamond abrasive grinding wheel. When grinding a curved groove in a work piece, the effective radius of the groove can thereby be altered for a desired wider or narrower groove in a particular work piece such as a cutting tool 37 as shown in FIGS. 8 and 9.

The grinding wheel 14 is secured to the rotor 40 of a variable speed electric motor 42 which is mounted in an elevated position on the motor mount for fixed positioning of the grinding wheel 14 with respect to the movable work piece table 16. The motor 42 is provided with a shield 43 covering in part the grinding wheel 14 for the protection of the user.

Figure 6:
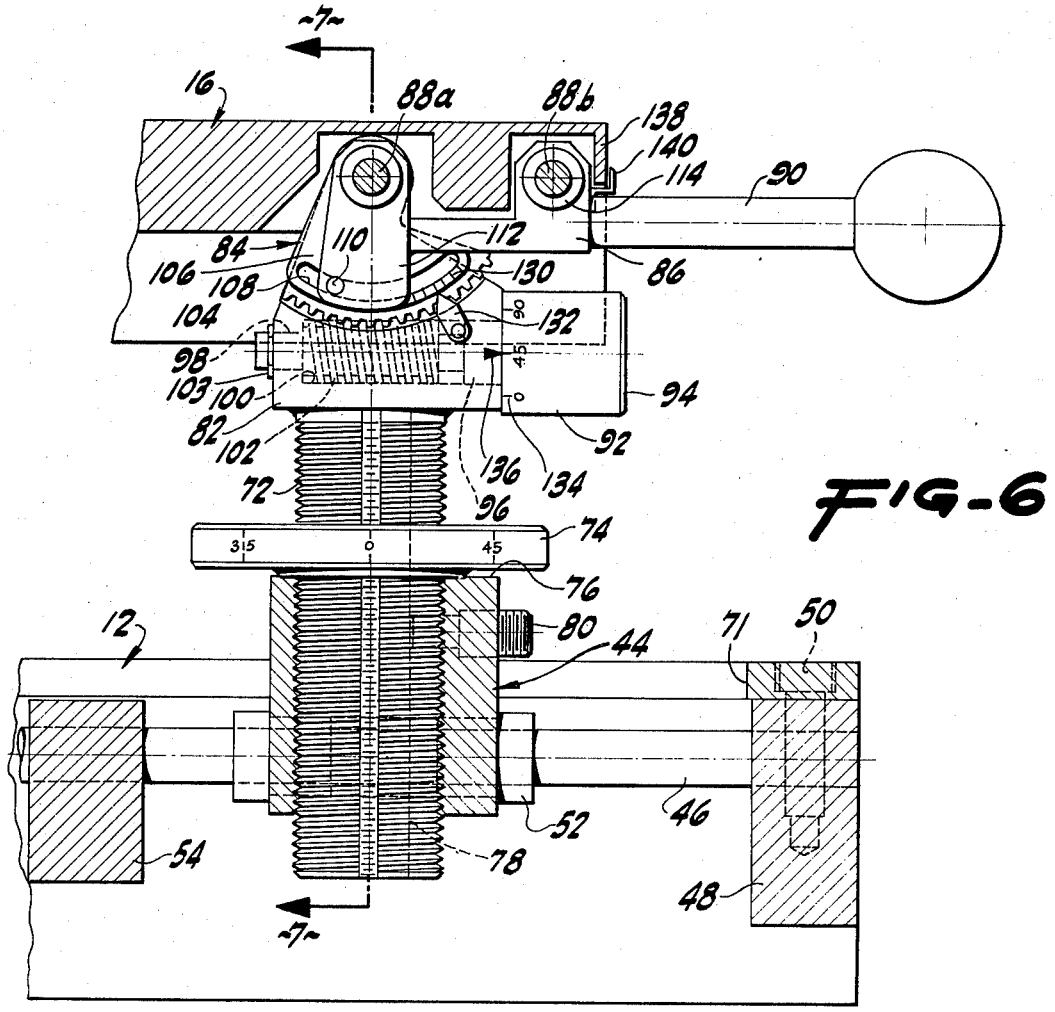
FIG. 6 is an enlarged partial view of the cross-sectional view of FIG. 5.

The work-piece table 16 is connected to the base platform by means which provide a delimited articulation and transport to the table, enabling the user to control the motion of the work-piece with respect to the grinding wheel by manual guidance of the table. In this manner the user retains a substantial "feel" when transforming the work-piece, but a steadiness and control by reason of the delimited articulation and transport of the working table. This is accomplished first by a transport carriage 44 for the table which is slidably mounted on two stationary parallel guide rods 46 which function as a way, as shown in FIG. 6. The guide rods 46 are mounted in two depending, opposed mounting blocks 48 secured by bolts 50 to the underside of the top plate 30 of the base platform 12, as shown in FIG. 4. The transport carriage 44 includes sleeve bearings 52 for smooth fore and aft movement of the carriage and transported working table with respect to the grinding wheel.

Forward movement of the carriage 44 is selectively limited by a stop block 54, which is also slidably mounted on the parallel guide rods 46. The stopping block 54 includes a tapped hole 56 through which a lead screw 58 is threaded. The lead screw 58 is journaled at each end to the mounting blocks 48 by bearings 60 and clips 62, allowing free rotation on the lead screw by manipulation of an adjustment knob 64 at the end of the screw 58. In this manner, the stop block can be displaced and located as desired, thereby limiting the foreward movement of the carriage 44. A second similarly arranged stop block with associated lead screw can be located on the opposite side of the carriage to limit aft movement of the table. However, in the preferred embodiment this has been found to be of only marginal use and is to be considered an optional addition.

To fix the position of the carriage 44 and hence the table 16, a locking screw 65 threads through the side of the carriage 44 to contact one of the guide rods 46 when tightened. The locking screw 65 projects through an elongated slot 66 in the side of the base platform 12 and includes an adjustment knob 68 at its end for convenient manipulation.

Figure 5:
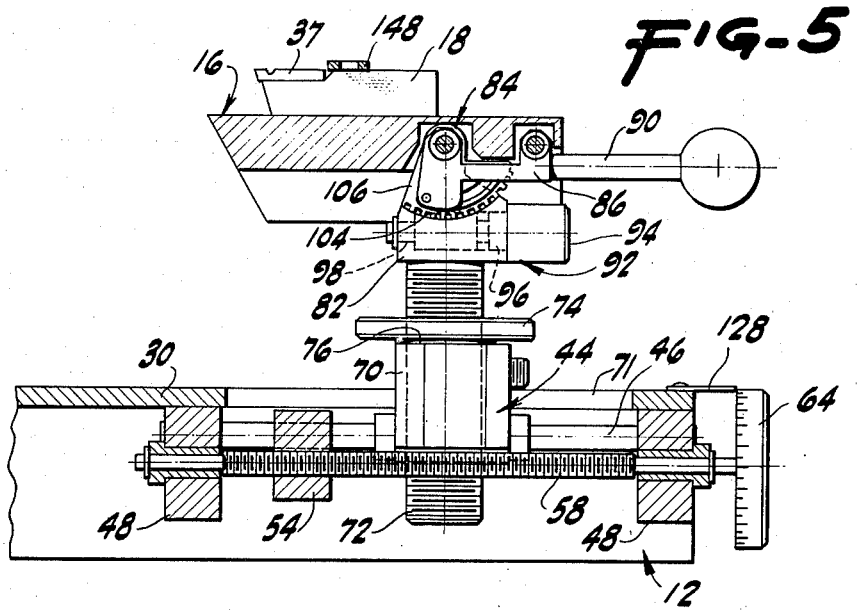
FIG. 5 is a cross-sectional view taken on the lines 5—5 in FIG. 1.

Integral with the carriage is a pedestal socket 70, shown also in FIG. 5, which projects up through an elongated, wide slot 71 in the top plate 30 of the base platform 12. A support column 72 for the working table 16 is inserted into and carried by the pedestal socket 70. The support column 72 is threaded and includes an annular, threaded adjustment collar 74 which seats on the top bearing surface 76 of the pedestal socket 70. The adjustment collar 74 allows selective positioning of the support column 72 in the pedestal socket 70 and hence controls the elevation of the table. A locating slot 78 on the support column 72 along the axis of the column cooperates with a set screw pin 80 in the pedestal socket 70 to maintain the alignment of the column and table. The set screw pin 80 further operates as a locking device when tightened preventing accidental displacement of the table on inadvertent movement of the collar 74, or, dislocation of the table on transportation.

Figure 7:
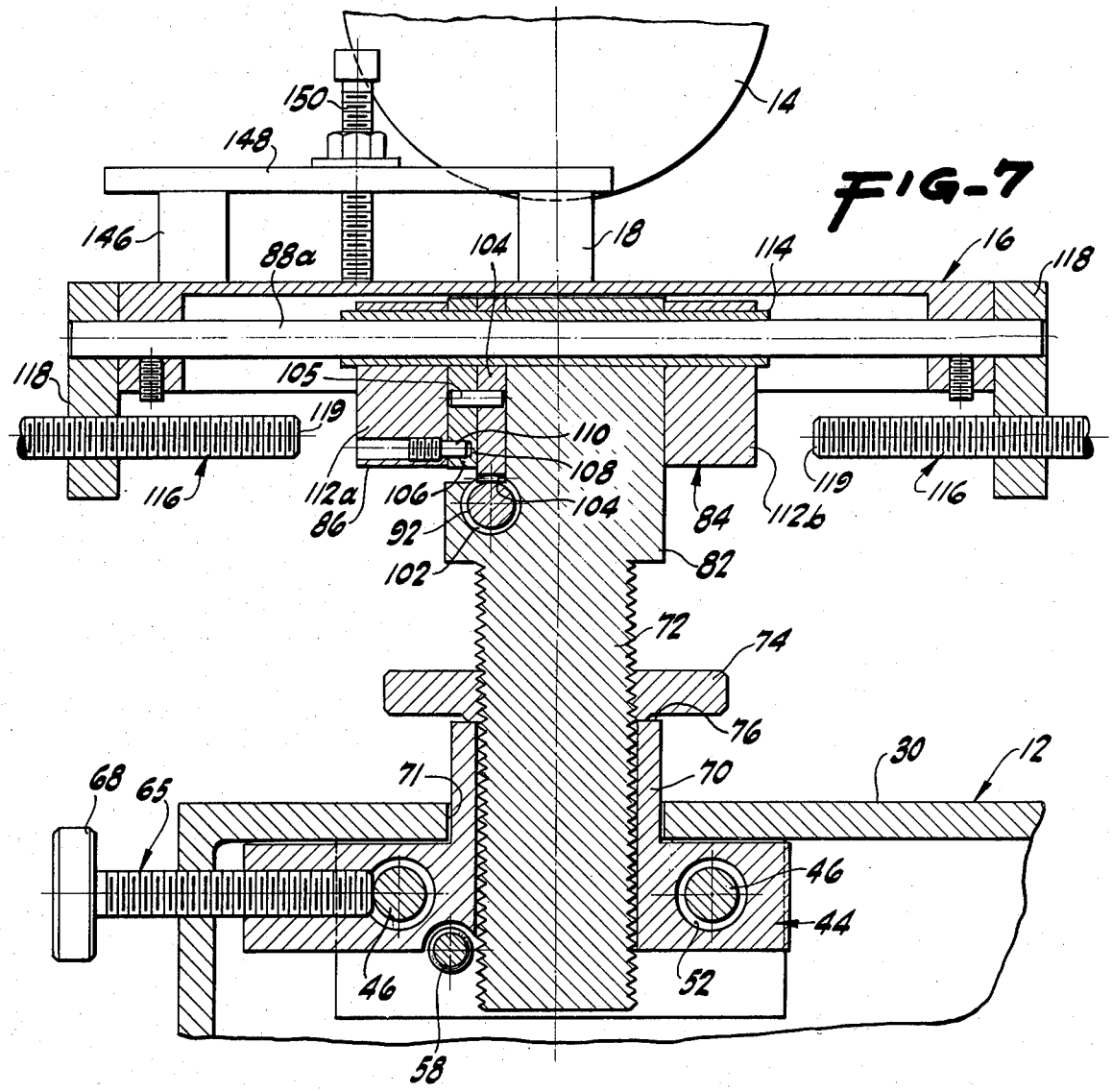
FIG. 7 is a cross-sectional view taken on the lines 7—7 in FIG. 6.

Connected at the upper end of the support column 72 is a head block 82. Referring also to FIGS. 6 & 7 the head block 82 comprises the connecting support for the table tilt and slide mechanisms. The tilt mechanism 84 comprises a tilt bed 86 pivotally connected to the head block 82 by one 88*a* of two table slide rods 88*a* and 88*b*. Control of the pivot about the axis of the slide rod 88*a* is manually directed through the operator's lever 90, which is fixed to and projects from the tilt bed 86. Since the fore edge of the table 16 is able to pivot up into the grinding wheel, the degree of pivot must be accurately limited by an adjustment means to allow close tolerance of the desired depth of grinding on the work-piece, or for protection during periods of non-use to prevent table contact with the grinding wheel that may damage the wheel. This limited tilting ability is one of the key features in enabling a machinist to accurately machine the exotic configurations of the modern cutting tool.

The adjustment means comprises an adjustment control knob 92 having a knob head 94, a throat 96 and a narrowed toe 98. The control knob 92, journaled in a conforming socket 100 in the head block 82, has a central worm gear 102. The rotatable control knob 92 is retained in the head block 82 by toe clip 103. The worm gear 102 engages an arcuate gear rack 104 mounted by pin 105 to an adjustable stop plate 106 pivotally connected to the table slide rod 88*a*. The stop plate 106 includes an arcuate guide slot 108 which is engaged by a stop pin 110 in a depending segment 112 of the tilt bed 86. The location of the stop plate 106 is determined by positioning of the integrally attached gear rack 104 through rotation of the worm gear 102 by the control knob 92. The pin 110 travels freely in the guide slot 108 until the end of the slot is contacted where further travel or tilt is inhibited. In this manner the tilt bed 86 and hence the connected working table 16 is allowed to tilt within the angular limit set by the positioning of the guide slot. The tilt mechanism is limited in its upward tilt, where the work-piece is brought into contact with the lower edge of the grinding wheel. Again, as in the limit stop for the fore and aft displacement of the table, an additional stop for concurrently adjusting the downward tilt may be added to the other side of the head block if it is found desirable for future grinding operations. However, at present such addition is of marginal value and is not necessary for the cutting tool preparations contemplated.

As shown in FIGS. 6 and 7, the tilt bed 86 is connected to the working table by the two slide rods 88*a* and 88*b* mounted in the hollowed-out underside of the table. The slide rods 88 pass through bearings 114 to the tilt bed 86 enabling the table to slide back and forth with respect to the tilt bed in a reciprocal direction perpendicular to the fore and aft displacement of the transport carriage 44. This table displacement on the tilt bed is generally perpendicular to the axis of rotation of the grinding wheel 14. The back and forth displacement of the table is limited by threaded stop bolts 116 threadably mounted on depending table sides 118 on each side of the work table. The ends 119 of the threaded stop bolts 116 contact the depending segments 112*a* and 112*b* of the tilt bed 86. In this manner the displacement is adjustably limited at each end. The stop bolts 116 are provided with knobs 120 for adjusting the position of the bolt ends with respect to the tilt bed and for use as a hand-hold in manually controlling the reciprocal displacement of the table as required in finishing the workpiece.

The grinding device 10 includes various graduated indicies for aiding the user in setting up operations and in logging operations for subsequent duplication. While placement and calibration of such indicies may be further refined for quantitative as well as comparative analysis, the indicies shown are suitable. In FIG. 4 the fore and aft table displacement can be determined by the graduated scale 121 on the top plate 30 of the base platform 12 and its relation to indicator arrow tabs 122 and 124 on the pedestal socket 70 and stop block 54 respectively. Refinement of measurements can be taken from the angular displacement of the stop block adjustment knob 64 as determined from index marks 126 on the knob and the fixed arrow tab 128 on the top plate 30 of the base platform 12.

Table tilt limit can similarly be defined by index marks 130 on the stop plate 106 as referenced to an arrow tab 132 on the head block 82. Refinements and determined by angular displacements of the adjustment control knob index marks 134 with respect to a face mark 136 on the head block 82.

Back and forth displacement can be determined by index marks (not visible) on the fore edge 138 of the table with respect to an arrow tab 140 located over the operator's lever 90.

With such aids, the user can better set up and execute grinding operations that duplicate prior successful operations while retaining the general close feel necessary to properly prepare the complex edges and surfaces necessary for the modern cutting tools or inserts.

The cutting tool or inserts to be prepared is clamped to the table by a clamping mechanism 142, shown in FIGS. 1, 2 and 7, which includes a spacer block 146, a tie-down dog 148, and a threaded clamping bolt 150 which engages one of a plurality of spaced threaded holes 152 in the top of the table 16. In this manner, the work piece 18 can be located anywhere on the table for select grinding operations by the grinding wheel as shown in FIGS. 8 and 9. With the ability to adjust the angle presentation of the wheel as shown in FIGS. 8 and 9, and with the ability to control the articulation and height of the table by the stops, allowing a variety of angle presentations of the table other than the horizontal presentation shown, the grinding wheel can form a variety of different groove or cut configurations.

While in the foregoing specification embodiments of the invention have been set forth in considerable detail for the purposes of making a complete disclosure of the invention, it will be apparent to those of ordinary skill in the art that numerous changes may be made in such details without departing from the spirit and principles of the invention.

What is claimed is:

1. A grinding device particularly designed for preparing cutting edges of cutting tools comprising:

a rotary grinding wheel connected to rotary drive means for rotating said wheel about a rotation axis; said drive means having mounting means for positioning said grinding wheel with respect to a work piece; a work piece table having means for mounting a work piece thereon, said work piece table having articulation means with first and second articulation stops for freely articulating said table on a pivotal table axis generally perpendicular to said rotation axis of said grinding wheel between said stops, and table transport means for reciprocally transporting said table in a linear direction parallel to said table axis; table support means for pivotally supporting said table and said articulation and transport means with respect to said grinding wheel; and, base support means for supporting said table support means, said base support means having table support transport means for selectively transporting said table support means and said table in a linear direction generally parallel to said rotation axis of said grinding wheel and perpendicular to said direction of said table axis, wherein said articulation means and transport means comprise a tilt and slide mechanism having a combination tilt and slide rod enabling pivot articulation and linear transport of said table with respect to said table support means.

2. The grinding device of claim 1 wherein said tilt and slide mechanism includes a second slide rod parallel to said first tilt and slide rod providing added stability to said transport means.

3. The grinding device of claim 2 wherein at least one of said articulation stops is adjustable.

4. The grinding device of claim 2 wherein said support means includes elevation means for selectively raising and lowering said table with respect to said grinding wheel.

5. The grinding device of claim 2 wherein said mounting means for positioning said grinding wheel has adjustment means for effectively widening a groove cut with said grinding wheel, said adjustment means having a mounting construction providing limited arcuate adjustment of said grinding wheel on said base support means wherein the rotation axis of said grinding wheel is selectively skewed with respect to said table within narrow limits.

6. A grinding device particularly designed for preparing cutting edges of cutting tools comprising:

a rotary grinding wheel connected to rotary drive means for rotating said wheel about a rotational axis; said drive means having mounting means for positioning said grinding wheel with respect to a work piece; a work piece table having means for mounting a work piece thereon, said work piece table having articulation means for freely and pivotally articulating said table on a table axis generally perpendicular to said rotation axis of said grinding wheel and transport means for reciprocally transporting said table in a linear direction parallel to said table axis; and, table support means for supporting said table and said articulation and transport means with respect to said grinding wheel;

wherein said articulation and transport means comprises a tilt and slide mechanism having first and second displaced parallel rods mounted to said table, and having a tilt bed with slide bearing means engaging said first and second rods for delimited reciprocal slide transporting of said table with respect to said bed, wherein said first rod comprises a pivot rod, said support means having cooperating pivot bearing means engaging said pivot rod for pivoting said bed and connected table with respect to said support means.

7. The grinding device of claim 6 wherein said tilt and slide mechanism and said support means cooperatively include stop means for delimiting the degree of pivotal articulation of said table.

8. The grinding device of claim 7 wherein said stop means is selectively adjustable and includes a stop device on said tilt bed and an adjustable stop device on said support means, said stop device on said support means being selectively adjustable with respect to said stop device on said tilt bed to selectively limit the degree of pivot of said table.

9. The grinding device of claim 6 wherein said transport means includes adjustable stop means for selectively delimiting reciprocal transport of said table with respect to said support means.

10. The grinding device of claim 9 wherein said adjustable stop means comprises opposed threaded adjustment screws on said table oppositely directed at and selectively contacting said slide carriage.

11. The grinding device of claim 6 wherein said support means includes elevation means for selectively raising and lowering said table with respect to said grinding wheel.

12. The grinding device of claim 6 comprising further base support means for supporting said table support means, said base support means having transport means for selectively transporting said table support means and said table on an axis generally parallel to said rotation axis of said grinding wheel.

13. The grinding device of claim 6 wherein said mounting means for positioning said grinding wheel has adjustment means for limited arcuate adjustment of said grinding wheel wherein the rotation axis of said grinding wheel is selectively skewed with respect to said table within narrow limits.

* * * * *